US008204753B2

(12) United States Patent
Kumar

(10) Patent No.: US 8,204,753 B2
(45) Date of Patent: Jun. 19, 2012

(54) STABILIZATION AND GLITCH MINIMIZATION FOR CCITT RECOMMENDATION G.726 SPEECH CODEC DURING PACKET LOSS SCENARIOS BY REGRESSOR CONTROL AND INTERNAL STATE UPDATES OF THE DECODING PROCESS

(75) Inventor: Sanjeev Kumar, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 952 days.

(21) Appl. No.: 12/190,094

(22) Filed: Aug. 12, 2008

(65) Prior Publication Data

US 2009/0125302 A1 May 14, 2009

(30) Foreign Application Priority Data

Aug. 23, 2007 (IN) ..... 1894/CHE/2007

(51) Int. Cl.
*G10L 21/00* (2006.01)

(52) U.S. Cl. ..... 704/500; 714/758

(58) Field of Classification Search ..... 704/500; 714/758

See application file for complete search history.

(56) References Cited

U.S. PATENT DOCUMENTS

| | | | | |
|---|---|---|---|---|
| 5,925,146 | A * | 7/1999 | Murata et al. | 714/746 |
| 2004/0123228 | A1 * | 6/2004 | Kikuchi et al. | 714/800 |
| 2007/0100614 | A1 * | 5/2007 | Yoshida et al. | 704/223 |

* cited by examiner

*Primary Examiner* — Daniel D Abebe

(74) *Attorney, Agent, or Firm* — Robert D. Marshall, Jr.; Wade James Brady, III; Frederick J. Telecky, Jr.

(57) ABSTRACT

This invention decoded encoded speech using alternative parameters upon detection of a lost packet. Upon detection of a first good packet following packet loss, this invention uses second alternative parameters intermediate between the default parameters and the alternative parameters for a predetermined interval. Thereafter the invention reverts to the default parameters. This minimizes glitches in the decoded speech upon packet loss. This invention is suitable for use in decoding speech data encoded in the CCITT Recommendation G.726 ADPCM based speech coding standard.

20 Claims, 3 Drawing Sheets

STABILIZATION AND GLITCH MINIMIZATION FOR CCITT RECOMMENDATION G.726 SPEECH CODEC DURING PACKET LOSS SCENARIOS BY REGRESSOR CONTROL AND INTERNAL STATE UPDATES OF THE DECODING PROCESS

TECHNICAL FIELD OF THE INVENTION

The technical field of this invention is speech data coding and decoding.

BACKGROUND OF THE INVENTION

CCITT Recommendation G.726 is a widely used, early speech coding standards for telephony. Recently in digital and packet communication systems, packet loss handling mechanism has become very common in the current communication scenarios using VOIP (voice over Internet Protocol) and other packet networks. But the current CCITT Recommendation G.726 does not support any mechanism for packet loss recovery. Thus quality goes down in case of packet loss with bad artifacts and glitches in the speech. These glitches and artifacts are hard to compensate in any subsequent packet loss algorithm and system such as G.711. So there is need to minimize these glitches for proper functioning of a G.726 codec in packet loss scenarios.

In a CCITT Recommendation G.726 system the encoder and decoder states are coupled. During packet loss, the encoder and decoder lose their ability to track states. In addition the tone detector is somewhat ad-hoc and further deteriorates the state tracking ability of the decoder. For tone detection, the predictor poles and zeros are set to zero values. This tone detection also detects the false tones in the normal speech signals. Thus a frame loss makes it very difficult for the decoder to track the encoder because the tone detector would set the predictor poles and zeros to zero values. In this state, the codec output exhibits glitch artifacts in the output speech.

A G.726 codec is Adaptive Differential Pulse Code Modulation (ADPCM) based and operates at 16, 24, 32 or 40 K bits/sec. The codec converts 64 K bits A-law or μ-law pulse code modulated (PCM) channels to and from a 16, 24, 32 or 40 K bits/sec channels using ADPCM transcoding. The heart of the codec is the sign-sign (SS) and leaky LMS algorithm.

SUMMARY OF THE INVENTION

This invention changes the G.726 decoding process to control glitches in the output speech upon packet loss. This invention does not change the encoder thus maintaining compatibility with the existing deployed encoders. This invention has minor data processing capacity and memory impact, handles the glitches upon packet loss to a great extent, maintains the perceived quality of the output speech and minimizes glitch artifacts. This invention controls the dynamics such as excitation, step size and leak factors of the decoder during packet loss. This controls these artifacts and produces a better Mean Opinion Score (MOS) score for the output speech.

The G.726 standard uses a sign-sign algorithm (SSA). In the sign-sign algorithm the adaptation is based on the sign of the regressor and the sign of the error signal. The SSA is given by:

$$H(n+1)=H(n)+\mu sgn\{X(n)sgn\{e(n)\}\}, \tag{1}$$

$$e(n)=d(n)-H(n)^{\tau}X(n), \tag{2}$$

$$X(n)=[x(n)x(n-1)\ldots x(n-N_1)^{\tau}], \tag{3}$$

$$sgn\{X(n)\}=[sgn\{x(n)\}sgn\{x(n-1)\}\ldots sgn\{x(n-N+1)\}]^{\tau}, \tag{4}$$

Where: x(n) is the reference input at time n; d(n) is the desired response; N is the number of filter taps; $X(n)\in\Re^N$ is the input regressor; $H(n)\in\Re^N$ is the filter coefficients; e(n) is the estimation error; and μ is the step size. Sgn is the sign function defined as:

$$\mathrm{sgn}\{x\}=\begin{Bmatrix} 1, & \text{if } x>0, \\ 0, & \text{if } x=0, \\ -1, & \text{if } x<0 \end{Bmatrix} \tag{5}$$

The sign-sign and leaky least mean squared (LMS) algorithms are the hardest of the least mean squared family to analyze due to two sign nonlinearities. The signed regressor algorithm is very sensitive to persistency of the excitations conditions. This is not equivalent to persistence excitation for non-sign least mean squared. There is no excitation during packet loss. Thus upon packet loss these algorithms tend to diverge. Due to these complexities and issues with the sign-sign least mean squared and leaky least mean squared algorithm, divergence and stability issues are more prominent than the usual LMS algorithm in G.726 ADPCM codec.

Tone detection is based on a threshold of the predictor pole amplitude (a2) and quantization error. This provides a false detection many times. According to the prior art, after tone detection the poles and zeros of the predictor are set to zero. During packet loss it is very difficult to synchronize the encoder-decoder state if this reset to zero happened during the lost frame.

A significant improvement in the glitch appearance occurs with removal of this tone detection and reset of the predictors to zero. But this change would require new tone detections at both decoder and encoder. Encoder changes would not preserve compatibility with existing installations.

The current form of the G.726 codec does not support any packet loss concealment procedure. Due to the encoder-decoder state coupling and the ad-hoc tone detector that resets the predictor upon tone detection, the encoder-decoder loses state tractability on packet loss. This causes the decoder to lose state tracking synchronization with the encoder. In this non-synchronous operation of the codec, the predictor at decoder generally takes several frames to resynchronize with the encoder. The decoder also typically hits the hard thresholds of the parameters limit used to control codec stability. This process causes glitches in the output speech supplied to the end user.

This invention is a regressor and some internal state control of the decoding process which minimize the glitches in the output speech upon packet loss. This invention produces glitch minimization and better output speech quality in terms of Mean Opinion Score (MOS) for CCITT Recommendation G.726 ADPCM based speech coding standard upon packet loss.

The least mean square (LMS) in the G.726 standard is a sign-sign and leaky algorithm having a two poles and six zeros predictor. This prior art predictor needs persistent excitation to operate stably. In this invention during packet loss, the decoder is excited by the pitch quantized inputs of the previous packet. The leak factor and the step size of the predictor are controlled in two steps to have the better performance and stability during and just after packet loss. In this two step control: step one changes the leak factor and step size during the packet loss; and step 2 changes the leak factor and step size upon reception of the very first good packet for the duration of one pitch period overlap. Similarly the scale factor of speed control adaptation is controlled in two steps during the packet loss.

These changes to the existing G.726 decoder add very marginally to the data processing and the memory requirements of the existing algorithm. The MOS results of this invention are better than the existing G.726 decoder upon packet loss.

BRIEF DESCRIPTION OF THE DRAWINGS

These and other aspects of this invention are illustrated in the drawings, in which.

DETAILED DESCRIPTION OF PREFERRED EMBODIMENTS

The G.726 standard predictor algorithm is sign-sign and hence its stability and operating conditions are sensitive to the persistency of the excitation. The standard typically uses regressor excitation.

Figure 1:
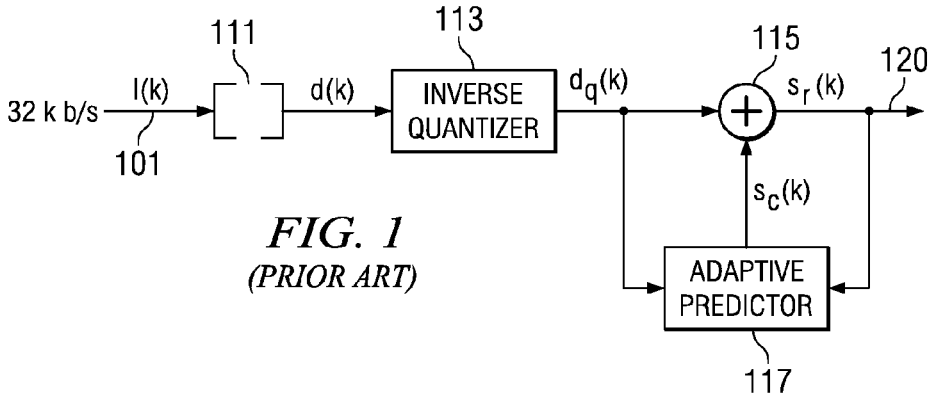
FIG. 1 (PRIOR ART)
FIG. 1 is a simplified block diagram of a G.726 standard decoder (prior art)

FIG. 1 is a simplified block diagram of a G.726 standard decoder. In this example input 101 I(k) is 32 Kbits/sec. PCM converter 111 converts the PCM input I(k) into normal digital data d(k). Inverse quantizer 113 reverses quantization in the data d(k) provided by the encoder (not shown). The dequantized data $d_q(k)$ supplies one input of adder 115. Inverse quantizer 113 also supplies this dequantized data $d_q(k)$ to adaptive predictor 117. Adaptive predictor 117 receives another input from the output $s_r(k)$ of adder 115. Adaptive predictor 117 produces a prediction signal intended to track the encoder to the second input of adder 115. The output $s_r(k)$ of adder 115 forms the decoder output 120.

Figure 2:
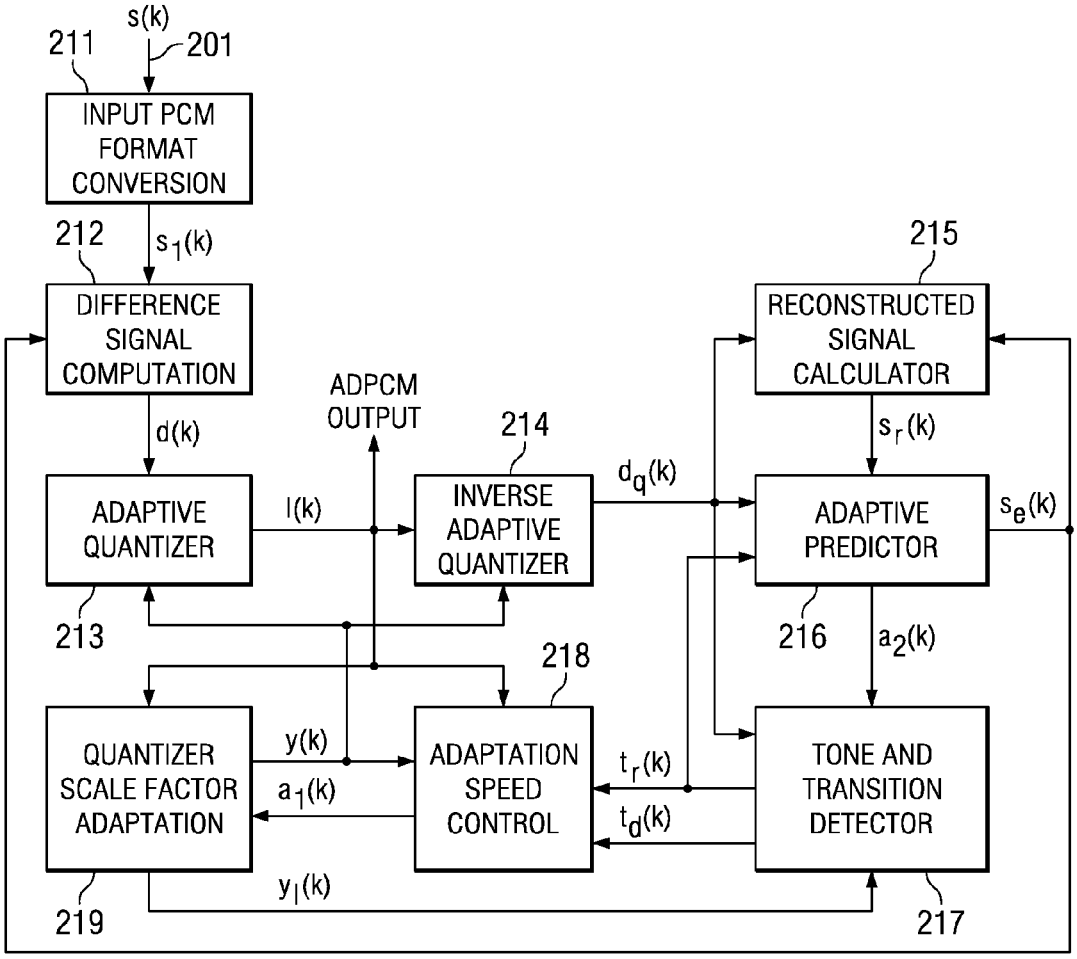
FIG. 2 (PRIOR ART)
FIG. 2 is a detailed block diagram of a G.726 standard encoder (prior art)

FIG. 2 is a detailed block diagram of a G.726 standard encoder. Input PCM format conversion circuit 211 converts input data 201 s(k) into PCM data $s_l(k)$. PCM data $s_l$ (k) supplies the input to difference signal computation circuit 212. Difference signal computation circuit 212 computes a difference signal d(k). Difference signal d(k) supplies one input to adaptive quantizer 213. Adaptive quantizer 213 quantizes the difference signal d(k) and produces an output I(k) which serves as the ADPCM output. Adaptive quantizer is adaptive as follows. The ADPCM output I(k) supplies one input of inverse adaptive quantizer 214. Inverse adaptive quantizer 214 helps provide a better adaptive quantization by anticipating the decoder response. Inverse adaptive quantizer 214 produces an adaptive inverse quantization signal $d_q(k)$. This inverse quantization signal $d_q(k)$ supplies reconstructed signal calculator 215, adaptive predictor 216 and tone and transition detector 217. Reconstructed signal calculator 215 supplies reconstructed signal $s_r(k)$ to adaptive predictor 216 dependent upon the inverse quantization signal $d_q(k)$ and the adaptive predictor signal $s_e(k)$ from adaptive predictor 216. Adaptive predictor 216 produces adaptive predictor signal $s_e(k)$ supplied to reconstructed signal calculator 215 and difference signal computation circuit 212 and signal $a_2(k)$ supplied to tone and transition detector 217 based upon the inverse quantization signal $d_q(k)$, the reconstructed signal $s_r(k)$ from adaptive predictor 216 and the signal $t_r(k)$ from tone and transition detector 217. Tone and transition detector 217 detects tones and transitions in the data. Tone and transition detector 217 receives the inverse quantization signal $d_q(k)$, the signal $a_2(k)$ from adaptive predictor 216 and signal $y_l(k)$ from quantizer scale factor adaptation circuit 219 and produces a signal $t_r(k)$ supplied to both adaptive predictor 216 and adaptation speed control 218 and signal $t_d(k)$ supplied only to adaptation speed control 218. Adaptation speed control 218 receives the inverse quantization signal $d_q(k)$, both the $t_r(k)$ and the $t_d(k)$ signals from tone and transition detector 217, and signal y(k) from quantizer scale factor adaptation circuit 219 and produces adaptive speed control signal $a_1(k)$ supplied to quantizer scale factor adaptation circuit 219. Quantizer scale factor 219 receives the inverse quantization signal $d_q(k)$ and the signal adaptive speed control signal $a_1(k)$ from adaptation speed control 218 and produces signal y(k) supplied to adaptive quantizer 213, inverse adaptive quantizer 214 and adaptive speed control 218 and signal $y_l(k)$ to tone and transition detector 217.

Figure 3:
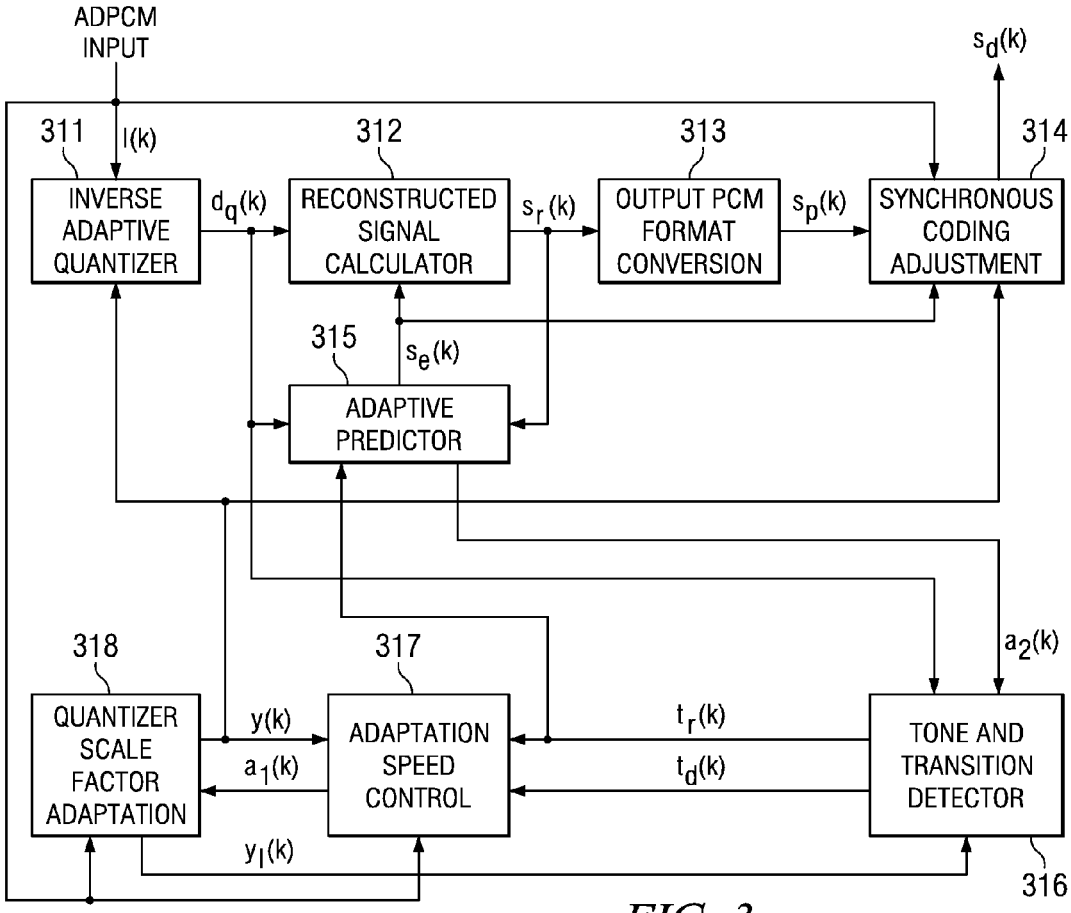
FIG. 3 (PRIOR ART)
FIG. 3 is a detailed block diagram of a G.726 standard decoder (prior art)

FIG. 3 is a detailed block diagram of a G.726 standard decoder. The decoder duplicates many parts from the adaptive feedback path of the encoder illustrated in FIG. 2. The ADPCM input I(k) is supplied to inverse adaptive quantizer 311, synchronous coding adjustment circuit 314, adaptation speed control 317 and quantizer scale factor adaptation circuit 318. Inverse adaptive quantizer 311, reconstructed signal calculator 312, adaptive predictor 315, tone and transition detector 316, adaptation speed control 317 and quantizer scale factor adaptation circuit 318 are connected to each other the same as respective inverse adaptive quantizer 214, reconstructed signal calculator 215, adaptive predictor 216, tone and transition detector 217, adaptation speed control 218 and quantizer scale factor adaptation circuit 219 illustrated in FIG. 2. The reconstructed signal $s_r(k)$ supplies an input to output PCM format conversion circuit 313. Output PCM format conversion circuit 313 converts reconstructed signal $s_r(k)$ into output PCM signal $s_p(k)$. Synchronous coding adjustment circuit 314 receives PCM signal $s_p(k)$, ADPCM input I(k) and signal y(k) from quantization scale factor adaptation circuit 318 and produces the recovered signal $s_d(k)$.

Figure 4:
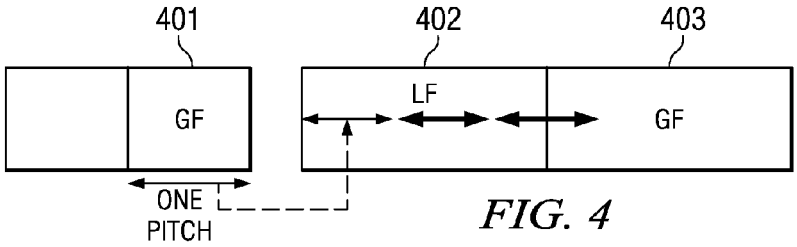
FIG. 4 illustrates operation of this invention upon packet loss.

FIG. 4 illustrates operation of this invention upon packet loss. Upon packet loss, the regressor input to the decoder is the one pitch regressor of the previous good frame filled into the lost frame. FIG. 4 illustrates good frame 401, lost frame 402 and following good frame 403. The regressor control of this invention is good enough to drive the predictor and helps in the decoder-encoder state tractability. In the prior art the pitch calculation is a correlation based using history of the past 80 samples. In this invention, the previous frame values of good frame 410 which are used for lost frame 402 are magnitude limited to the range of 0x0007 hex values. This controls divergence during the lost frame.

Figure 5:
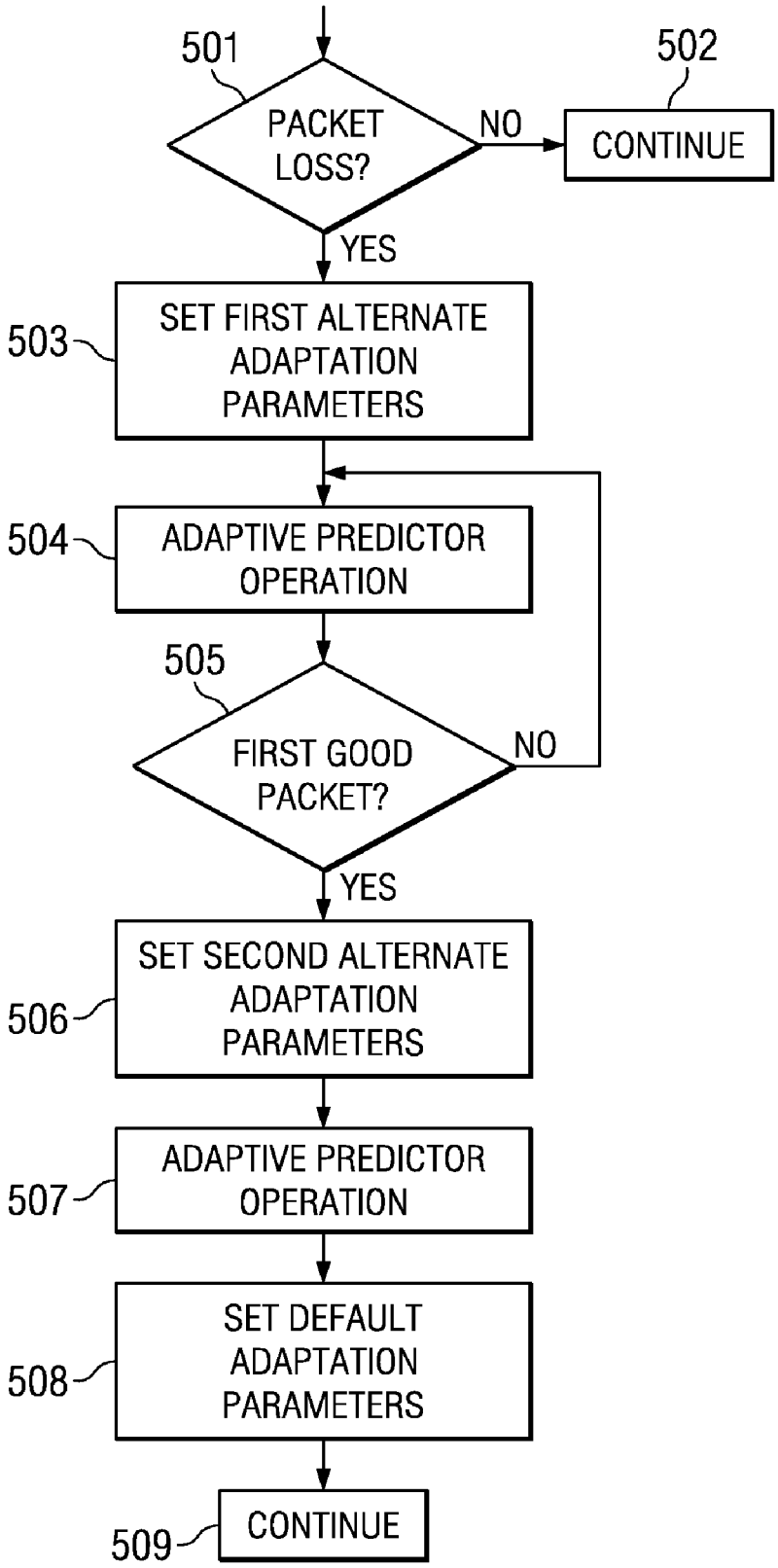
FIG. 5 is a flow chart illustrating operation of this invention.

FIG. 5 is a flow chart illustrating operation of this invention which is employed only upon packet loss. Decision block 501 determines whether data from a packet is lost. If a packet is not lost (No at decision block 501), then the decode algorithm continues according to the prior art (block 502). If a packet has been lost (Yes at decision block 501), then block 503 sets a first alternate adaptation parameters. Values for these parameters for a preferred embodiment are shown in Table 1 below. As shown in Table 1, these adaptation parameters include predictor poles step sizes and leak factors, quantization scale factors and adaptation speed control. During packet loss these first alternative parameters include larger values of the step size to track faster and larger leak factors to keep the predictor stable. This first alternate set of parameters includes a lower quantization scale factor and generally lower adaptation speed control.

Block 504 adaptively operates employing the first alternative parameters. Decision block 505 determines whether a first good packet is received. If a first good packet has not been received (No in decision block 505), then the invention repeats the adaptive predictor operation of block 505 using the first alternative parameters as before.

This loop repeats until decision block 505 detects the first good packet following the packet loss (decision block 501). If the current packet is the first packet following packet loss (Yes at decision block 505), then block 506 sets a second alternate parameters. Values for these parameters for a preferred embodiment are shown in Table 1 below. The parameters are set for this first good packet to intermediate values between the first alternate values and the default values for one pitch period to smoothen the transition from lost packet to good packet.

Block 507 adaptively operates using the second alternative parameters for this first good packet following packet loss. Block 508 then sets the default (normal execution value) parameters. Values for these parameters for a preferred embodiment are shown in Table 1. Normal operation continues via continue block 509.

The G.726 standard has the two poles and six zero predictor and the sign-sign leaky least mean squares adapts the predictor. In this invention during packet loss, these parameters are controlled. These parameters of the predictor are changed as shown in the Table 1. As shown in Table 1 the quantizer scale factor has smaller value during the packet loss and during the one pitch period of the first good packet received. The reduction in the quantizer scale factor helps in reducing the quantization error and drift. The values of the quantizer scale factor and the adaptation speed filters for one example of the two steps are shown in Table 1.

TABLE 1

| Parameter | During Lost Packet: First Alternative | Just After Lost Packet: Second Alternative | Normal Execution Value | Related Equations |
|---|---|---|---|---|
| Predicator Pole Step Size and Leak Factor Control | | | | |
| Predictor Pole update a1 | $3*2^{-7}$ | $3*2^{-7}$ | $3*2^{-8}$ | Equation (9) |
| Leak Factor Predictor Pole update a1 | $2^{-7}$ | $2^{-7}$ | $2^{-8}$ | |
| Step Size Predictor Pole update a1 | $2^{-5}$ | $2^{-6}$ | $2^{-7}$ | Equation (10) |
| Leak factor Predictor Pole update a2 | $2^{-6}$ | $2^{-6}$ | $2^{-7}$ | |
| Step Size | | | | |
| Predicator Zero Step Size and Leak Factor Control | | | | |
| Predictor Zero update $b_i$ 40 Kbps Leak factor | $2^{-10}$ | $2^{-8}$ | $2^{-9}$ | Equation (11) |

TABLE 1-continued

| Parameter | During Lost Packet: First Alternative | Just After Lost Packet: Second Alternative | Normal Execution Value | Related Equations |
|---|---|---|---|---|
| Predictor Zero update $b_i$ 32/24/16 Kbps Leak factor | $2^{-10}$ | $2^{-9}$ | $2^{-8}$ | |
| Predictor Zero update $b_i$ Step size | $2^{-8}$ | $2^{-6}$ | $2^{-7}$ | |
| Quantization Scale Factor Adaptation Control | | | | |
| $Y_u$(k) [filtd] | $2^{-9}$ | $2^{-9}$ | $2^{-5}$ | Equation (6) |
| Adaptation Speed Control | | | | |
| $D_{ms}$(k) [filta] | $2^{-7}$ | $2^{-5}$ | $2^{-5}$ | Equation (7) |
| $D_{ms}$(k) [filtb] | $2^{-9}$ | $2^{-7}$ | $2^{-7}$ | Equation (8) |

In the preferred embodiment these quantities are computed using the following equations. The quantization scale factor adaptation:

$$Y_{u'}(k)=(1-2^{-5})y(k)+2^{-5}W[I(k)] \tag{6}$$

Adaptation Speed Control:

$$d_{ms'}(k)=(1-2^{-5})d_{ms}(k-1)+2^{-5}F[I(k)] \tag{7}$$

$$d_{ml'}(k)=(1-2^{-7})d_{ml}(k-1)+2^{-7}F[I(k)] \tag{8}$$

Adaptation Poles Predictor:

$$a_1(k)=(1-\text{leak_factor})a_1(k^{-}1)+(\text{step_size})sgn[p(k)]sgn[p(k-1) \tag{9}$$

$$a_2(k)=(1-\text{leak_factor})a_2(k^{-}1)+(\text{step_size})\{sgn[p(k)]sgn[p(k-2)-f[a2(k-1)sgn[p(k)]sgn[pk(k-1)\} \tag{10}$$

Adaptive Zero Prediction:

$$b_i(k)=(1-\text{leak_factor})b_i(\text{k}-1)+(\text{step_size})sgn[d_q(k)]sgn[d_q(k-i)] \tag{11}$$

The effect of the glitches in the output reduces the output speech quality. Listening tests were conducted on Harvard Speech database (Clean and Noisy speech) to evaluate the performance of the algorithm. These listening tests used five listeners. All five listeners were asked to compare outputs from a prior art G.726 decoder with no glitch removal to the glitch removal of this invention on the Car 22 db Harvard Database with 3% random packet loss. The listeners compared the prior art speech REF_OUT with the inventive speech PLC_OUT using the scale shown in Table 2.

TABLE 2

| | | |
|---|---|---|
| Score | 0 | Both cases sound same |
| Score | 1 | PLC__OUT sounds slightly better then REF__OUT |
| Score | 2 | PLC__OUT sounds better than REF__OUT |
| Score | 3 | PLC__OUT sounds much better than REF__OUT |
| Score | −1 | REF__OUT sounds slightly better than PLC__OUT |
| Score | −2 | REF__OUT sounds better than PLC__OUT |
| Score | −3 | REF__OUT sounds much better than PLC__OUT |

Table 3 shows the results of the listening tests for 32 test vectors for the case of 40 Kbps. Similar results were obtained for the cases of 32, 24 and 16 Kbps.

TABLE 3

| Test Vector | Listener 1 | 2 | 3 | 4 | 5 |
|---|---|---|---|---|---|
| plcF01P01.300 vs. no__plcF01P01.300 | −1 | −2 | −1 | 0 | 0 |
| no__plcM01P01.300 vs. plcM01P01.300 | 2 | 3 | 1 | 1 | 1 |
| plcF01P02.300 vs. no__plcF01P02.300 | 1 | 0 | 0 | −1 | 0 |
| plcF01P04.300 vs. no__plcF01P04.300 | 1 | 0 | 0 | 1 | 0 |
| no__plcM01P03.300 vs. plcM01P03.300 | 2 | 1 | 1 | 0 | 0 |
| plcM01P02.300 vs. no__plcM01P02.300 | −1 | 0 | 0 | 0 | −1 |
| plcF01P08.300 vs. no__plcF01P08.300 | −1 | 0 | −1 | −1 | 0 |
| no__plcM02P01.300 vs. plcM02P01.300 | −1 | 0 | 1 | −1 | 1 |
| no__plcF01P05.300 vs. plcF01P05.300 | 1 | 2 | 0 | 0 | 1 |
| no__plcM01P05.300 vs. plcM01P05.300 | 0 | 0 | 0 | 0 | 0 |
| no__plcM01P06.300 vs. plcM01P06.300 | 0 | 0 | 0 | 1 | 0 |
| no__plcF02P03.300 vs. plcF02P03.300 | 0 | 0 | 0 | 0 | 0 |
| plcF01P07.300 vs. no__plcF01P07.300 | 0 | 1 | −1 | 0 | 0 |
| plcM01P07.300 vs. no__plcM01P07.300 | −1 | −1 | 1 | 0 | −1 |
| no__plcM01P08.300 vs. plcM01P08.300 | 1 | 2 | 0 | 1 | 1 |
| no__plcF01P06.300 vs. plcF01P06.300 | 2 | −1 | 0 | 0 | 0 |
| plcF02P02.300 vs. no__plcF02P02.300 | 2 | 2 | 0 | 0 | 0 |
| plcM02P02.300 vs. no__plcM02P02.300 | 0 | 0 | 0 | 0 | 1 |
| plcM02P03.300 vs. no__plcM02P03.300 | −1 | 0 | −1 | 0 | 0 |
| plcF01P03.300 vs. no__plcF01P03.300 | 1 | 1 | 1 | 0 | −1 |
| no__plcF02P04.300 vs. plcF02P04.300 | −2 | 1 | 1 | 0 | 0 |
| no__plcM02P04.300 vs. plcM02P04.300 | 2 | 1 | −1 | 1 | 0 |
| plcM01P04.300 vs. no__plcM01P04.300 | 1 | 1 | 0 | 0 | −1 |
| no__plcF02P07.300 vs. plcF02P07.300 | 1 | 1 | 1 | 1 | 1 |
| plcF02P05.300 vs. no__plcF02P05.300 | −2 | −1 | 0 | 0 | 0 |
| plcM02P05.300 vs. no__plcM02P05.300 | 0 | 0 | 0 | −1 | −1 |
| plcF02P06.300 vs. no__plcF02P06.300 | 1 | −1 | −1 | 0 | 0 |
| plcM02P06.300 vs. no__plcM02P06.300 | 2 | 0 | 1 | 1 | 0 |
| plcM02P08.300 vs. no__plcM02P08.300 | 0 | 0 | 0 | 0 | 0 |
| no__plcF02P01.300 vs. plcF02P01.300 | 2 | 1 | −1 | 0 | 0 |
| plcM02P07.300 vs. no__plcM02P07.300 | 0 | −1 | 1 | 0 | 0 |
| plcF02P08.300 vs. no__plcF02P08.300 | 0 | 1 | 0 | 0 | 0 |

Table 4 summarizes the results of the comparative listening tests for the five listeners. A Good result means the listener judged the inventive processed speech better than the prior art processed speech. A Bad result means the listener judged the prior art processed speech better than the inventive processed speech. A Neutral result means the listener judged the speech as having the same quality.

TABLE 4

| | Listener 1 | 2 | 3 | 4 | 5 |
|---|---|---|---|---|---|
| G (good) | G = 15 | G = 13 | G = 9 | G = 7 | G = 11 |
| B (bad) | B = 8 | B = 6 | B = 7 | B = 4 | B = 5 |
| Neutral (O) | O = 9 | O = 13 | O = 16 | O = 21 | O = 16 |
| MOS Improvement | 0.375 | 0.344 | 0.063 | 0.094 | 0.031 |

Following are the results drawn from the listening test. The average improvement was 0.18. This improvement varied 0.03 to 0.37. This is a quite significant improvement in case of speech codec. In these tests the MOS results indicated: the invention performed better than the prior art in 34.2% of cases; the invention performed worse in 19.5% of cases; and performance was the same in 46.1% of cases.

In the listening tests some of the test cases which are better in subjective listening have lower Perceptual Evaluation of Speech Quality (PESQ) scores than the reference speech. It looks like that PESQ is not the correct subjective measure wherever glitches are there in signal. Due to glitch removal and adaptation, the signal energy is less around the frame lost hence the PESQ score is slightly less in the inventive cases. But the average bound and variation around the mean of the PESQ of the inventive cases is better than the no glitch removal cases.

These proposed changes to the existing G.726 decoder marginally add to the data processing load and memory used in decoding. The additional data processing load is only some decision code and pitch calculation overheads as shown in FIG. 5. The memory used is about 600 words. Most of this additional required memory to implement this invention is needed for a pitch calculation buffer The MOS and PESQ results show the better performance of the new algorithm over the existing G.726 decoder upon packet loss. Glitches in output speech are minimized though not eliminated completely.

What is claimed is:

1. A method for decoding adaptively quantized speech data transmitted as packets comprising the steps of:

receiving packets of adaptively quantized speech data;

detecting a lost packet;

detecting a first good packet following detection of lost packet;

upon detection of a good packet not a first good packet following detection of a lost packet adaptively decoding the quantized speech data employing a default normal execution value of at least one parameter;

upon detection of a lost packet adaptively decoding the quantized speech data employing a first alternative value of the at least one parameter; and upon detection of a first good packet following detection of a lost packet adaptively decoding the quantized speech data employing a second alternative value of the at least one parameter, said second alternative value intermediate between the first alternative value and the default normal execution value.

2. The method of claim 1, wherein:

said at least one parameter includes a step size.

3. The method of claim 2, wherein:

said first alternative step size value is larger than said default normal execution step size value.

4. The method of claim 1, wherein:

said at least one parameter includes a leak factor.

5. The method of claim 4, wherein:

said first alternative leak factor value is larger than said default normal execution leak factor value.

6. The method of claim 1, wherein:

said at least one parameter includes a scale factor.

7. The method of claim 4, wherein:

said first alternative quantization scale factor value is smaller than said default quantization scale factor value.

8. The method of claim 1, wherein:

said at least one parameter includes an adaptive speed control.

9. The method of claim 8, wherein:

said first alternative adaptive speed control value is smaller than said default adaptive speed control value.

10. The method of claim 1, wherein:

said first alternative parameter value causes said adaptive decoding to converge slower than said default parameter value.

11. A method for decoding adaptively quantized speech data transmitted as packets comprising the steps of:

receiving packets of adaptively quantized speech data;

detecting a lost packet;

detecting a first good packet following detection of lost packet;

upon detection of a good packet a predetermined interval after detection of a first good packet following detection of a lost packet adaptively decoding the quantized speech data employing a default normal execution value of at least one parameter;

upon detection of a lost packet adaptively decoding the quantized speech data employing a first alternative value of the at least one parameter; and upon detection of a first good packet following detection of a lost packet and during said predetermined interval adaptively decoding the quantized speech data employing a second alternative value of the at least one parameter, said second alternative value intermediate between the first alternative value and the default normal execution value.

12. The method of claim 11, wherein:

said at least one parameter includes a step size.

13. The method of claim 12, wherein:

said first alternative step size value is larger than said default normal execution step size value.

14. The method of claim 11, wherein:

said at least one parameter includes a leak factor.

15. The method of claim 14, wherein:

said first alternative leak factor value is larger than said default normal execution leak factor value.

16. The method of claim 11, wherein:

said at least one parameter includes a scale factor.

17. The method of claim 16, wherein:

said first alternative quantization scale factor value is smaller than said default quantization scale factor value.

18. The method of claim 11, wherein:

said at least one parameter includes an adaptive speed control.

19. The method of claim 18, wherein:

said first alternative adaptive speed control value is smaller than said default adaptive speed control value.

20. The method of claim 19, wherein:

said first alternative parameter value causes said adaptive decoding to converge slower than said default parameter value.

* * * * *